US005109590A

United States Patent [19]

Endres

[11] Patent Number: 5,109,590

[45] Date of Patent: May 5, 1992

[54] MULTI CORE CABLE STRIPPING

[75] Inventor: Karl H. Endres, Gallo Manor, South Africa

[73] Assignee: Molex Incorporated, Lisle, Ill.

[21] Appl. No.: 455,208

[22] Filed: Dec. 21, 1989

[51] Int. Cl.[5] ..... H01R 43/04

[52] U.S. Cl. ..... 29/564.4; 29/749; 29/755; 29/857

[58] Field of Search ..... 29/564, 564.4, 749, 29/753, 755, 857, 861, 863

[56] References Cited

U.S. PATENT DOCUMENTS

| | | | |
|---|---|---|---|
| 3,588,984 | 6/1971 | Van de Kerkhof | 29/753 |
| 3,875,662 | 4/1975 | Folk | 29/863 |
| 4,363,167 | 12/1982 | Boutcher, Jr. et al. | 29/755 |
| 4,713,880 | 12/1987 | Dusel et al. | 29/564.4 |

*Primary Examiner*—Daniel W. Howell

*Attorney, Agent, or Firm*—Louis A. Hecht; Stephen Z. Weiss; Charles S. Cohen

[57] ABSTRACT

This invention relates to a method of and apparatus for stripping insulation from conductors of a multi core electrical cable and crimping an electrical terminal over the stripped portion of cable.

7 Claims, 1 Drawing Sheet

MULTI CORE CABLE STRIPPING

FIELD OF THE INVENTION

This invention relates to a method of and apparatus for stripping and terminating the conductors of multi core electrical cables which include a plurality of separately insulated conductors which are sheathed in an outer insulating sheath.

BACKGROUND TO THE INVENTION

Machines for stripping the insulation from the ends of insulated electrical conductors and then terminating the stripped ends of the conductors with electrical connector terminals are well known. The machines range between simple manually operable arrangements to highly complicated and expensive automatic machines such as those disclosed in American Pat. Nos. 3,875,662 and 4,713,880. The sophisticated automatic machines are made complicated by conductor gripping and moving fingers, conductor direction changing mechanisms elaborate conductor locator and feed arrangements and so on. Additionally, with most of the automatic machines manual operations such as initial insulation stripping need more often than not to be performed on the conductors prior to the terminals being crimped onto the stripped ends of the conductors.

OBJECT OF THE INVENTION

It is the object of this invention to provide a simple method of and apparatus for stripping the insulation from the insulated conductors of multi core cables.

SUMMARY OF THE INVENTION

A method of stripping and terminating the conductors of a multi core electrical cable according to the invention includes the steps of stripping a length of the outer insulation from one end of the cable to expose the separately insulated cable conductors, locating the insulated cable conductors in a holder with the free ends of the insulated conductors projecting in a spaced parallel relationship from the holder, activating a gripper to grip the insulation of the conductors in the holder, activating an insulation stripper to cut the insulation on each of the conductors at a predetermined distance from its free end and to hold the insulation between the cuts and free ends of the conductors, moving the holder while gripping the conductors in the axial direction of the conductors away from the stripper, to strip the free ends of the conductors from the insulation which is held by the stripper, to a position in which the stripped ends of the conductors are in register with the crimp portions of pre-located crimp-on electrical terminals and terminating the conductors by activating a crimp punch to crimp the terminals to the stripped ends of the conductors.

Preferably the method includes the step of vertically lowering the holder without a change of direction from the position in which the stripped ends of the conductors are in register with the crimp-on portions of the terminals and then activating the crimp punch.

Apparatus for stripping and terminating the conductors of a multi core electrical cable which carries separately insulated electrical conductors which are exposed at one end of the cable according to the invention includes a holder for holding the insulated conductors with the free end of each conductor projecting from the holder, a gripper for gripping the insulation of the conductors in the holder, means for actuating the gripper, a stripper arrangement including blades for cutting the insulation on each conductor at a predetermined distance from its free end and for holding the insulation between the cuts and the free ends of the conductors, means for actuating the stripper arrangement, means for moving the holder in the axial direction of the conductors to a second position away from the stripper arrangement to strip the free ends of the conductors from the insulation when held by the stripper, a crimp anvil which is located directly below the stripped ends of the conductors in the second position of the holder, a crimp punch and means for activating the crimp punch to crimp lugs located on the anvil to the stripped ends of the conductors.

Preferably the apparatus includes means for vertically lowering the holder without a change of direction from its second position to a third position in which the stripped ends of the conductors are located on the crimp portions of crimp lugs which are located on the crimp anvil in use.

BRIEF DESCRIPTION OF THE DRAWINGS

An embodiment of the invention is now described by way of example only with reference to the drawings in which.

DETAILED DESCRIPTION OF THE PREFERRED EMBODIMENT

Figures 1, 2, 3:
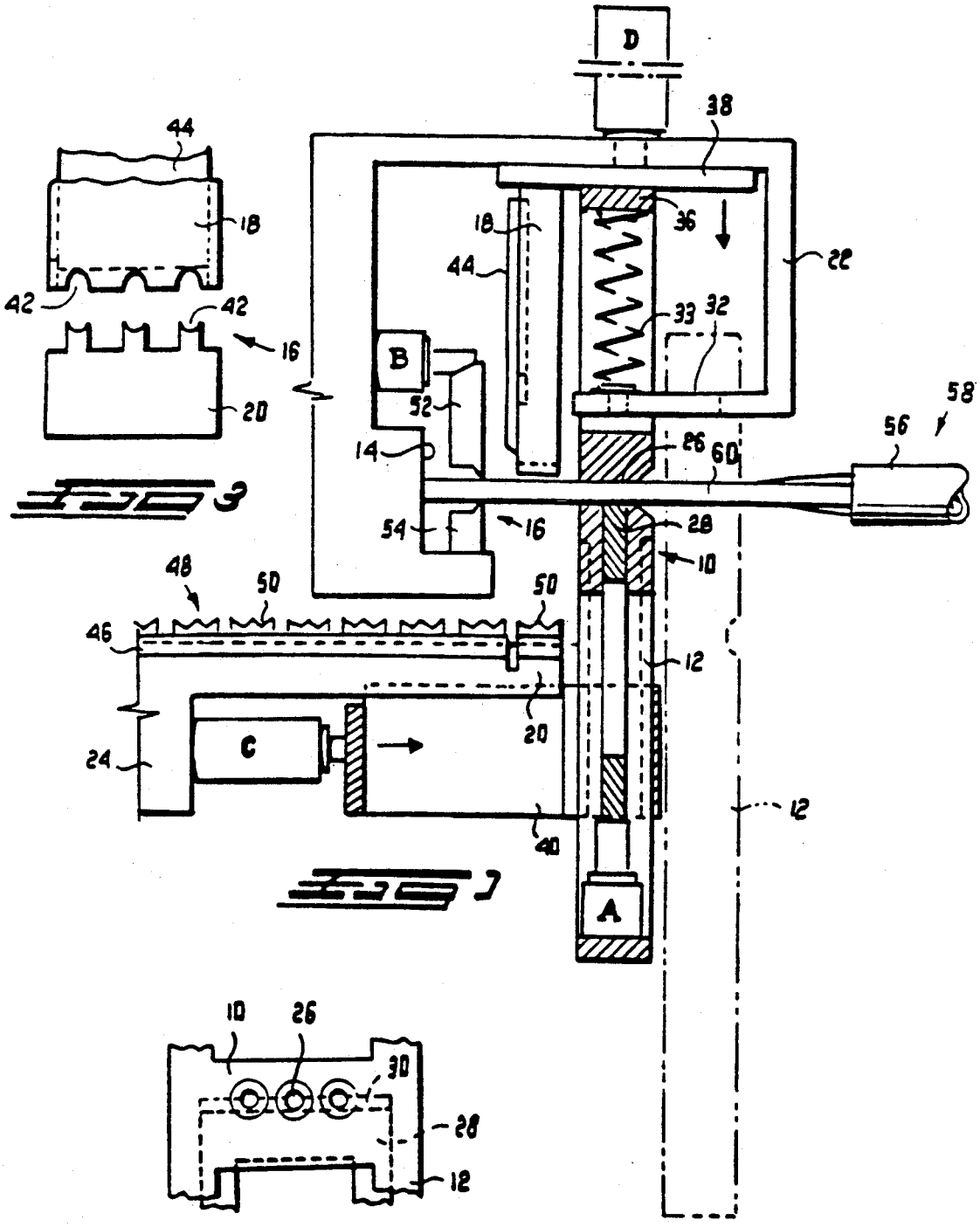
FIG. 1 is a partially schematic and partially sectioned side elevation of the cable stripping and terminating apparatus of the invention.
FIG. 2 is a fragmentary front elevation of the conductor holder of the FIG. 1 apparatus.
FIG. 3 is a fragmentary front elevation of the crimp punch arrangement of the FIG. 1 apparatus.

The cable stripping and terminating apparatus of the invention is shown in FIG. 1 to include a conductor holder 10 which is carried in a holder frame 12, a stop member 14, a conductor stripper arrangement 16, a crimp punch 18, a crimp anvil 20, and first and second frame elements 22 and 24 which, in the apparatus of the invention, are in fact two components of a single frame.

The conductor holder 10, as is also seen in FIG. 2, bridges spaced vertical elements of the holder frame 12. The holder includes, in this embodiment of the invention, three horizontally spaced bores 26 which are outwardly chamfered at their lead-in ends and a conductor gripper 28 which is vertically movable in a slot 30 in the holder body and slots in the vertical elements of the holder frame 12. The gripper 28 is movable from the position shown in FIGS. 1 and 2 to a slightly elevated position in which its upper edge intersects the bores 26 in the body of the holder 10. A leg 32 of the frame element 22 is located in an aperture at the upper end of the holder frame 12 and carries a slidable spring 33 which bears up against the underside of a cross member 36 of the frame 12 to bias the holder frame to the position shown in the drawing at which the upper surface of the cross member 36 bears against a platten 38. The cross member 36 is slidable against the undersurface of the platten. The platten 38 is downwardly movable from the position shown in the drawing by an air cylinder D.

The holder frame 12 is held vertically, as shown in FIG. 1, in a slide 40 which is movable to the right of the position shown in FIG. 1 by an air cylinder C to move the holder frame 12 to the chain dotted line position on the right hand side of the drawing. The holder frame 12 is vertically movable relatively to the slide 40 on opposite slide formations.

The upper end of the crimp punch 18 is fixed to the underside of the platten 38 and it and the crimp anvil, as shown in FIG. 3, each include three sets of crimping formations 42. The crimp punch 18 additionally carries a reciprocable terminal shearing blade 44. The crimp anvil 20 is located, as shown in FIG. 1, with its crimp formations 42 in register with channels on a strip feed table 46 which carries, in suitable guide slots, three U-shaped strips 48 of inter-connected electrical terminal sleeve blanks 50 which are fed in sequence towards the crimp anvil by cam operated feed fingers which are not shown in the drawing.

The conductor stripper 16 includes a downwardly movable blade 52 and a blade 54 which is fixed to the frame element 22. The cutting edges of the stripper blades carry arcuate cutting formations which are in register with the axes of the bores 26 in the holder 10 when the holder frame 12 is in the position shown in FIG. 1. The stripper blade 52 is downwardly movable from the position shown in FIG. 1 by an air cylinder B.

In use, the sheath 56 is stripped from the end portion of a three core cable 58 to expose the three conductors which are each sheathed in electrically insulating material 60. The free ends of the cable conductors are fed through the bores 26 in the holder 10 until their free ends abut the stop member 14, as shown in FIG. 1, in which position the insulation a little way from the end of each of the now parallel conductors is in register with the opposing cutting formations on the blades of the stripper arrangement. The operator of the machine now presses a foot pedal which activates air cylinder A to lift the gripper 28 into pressure contact with the conductors in the bores 26 of the holder 10 firmly to lock the conductors to the holder. After a short time delay air cylinder B drives the blade 52 of the stripper arrangement 16 downwardly to sever between it and the formations on the blade 54 the insulation around each of the conductors. The air cylinder B at this stage holds the blade 52 down in the insulation over the conductor wires. At the end of the extension stroke of the air cylinder B a limit switch is activated which activates cylinder C to move the slide 40 in the direction of the arrow in the drawing to bring the holder frame 12 into vertical register with the chain line position on the right hand side of the drawing. In moving the holder from the solid to chain line positions in the drawing the conductor wires between the stripper blades and the stop 14 are stripped from the insulation which is held by the stripper blades. At the limit of cylinder C's stroke the stripped ends of the three conductors 60 lie immediately beneath the crimping formations 42 of the crimp punch 18. Cylinder C now activates a switch which activates cylinder D and deactivates cylinder B to enable the stripper blades 52 and 54 again to move apart for the passage of fresh conductors. An air valve, not shown, is activated to blow the cut insulation pieces from the machine. In the meantime cylinder D moves the platten 38 downwardly until the stripped ends of the wires are positively nested in the uncrimped terminals 50 on the crimper anvil 20. The crimp punch 18 simultaneously crimps the terminals 50 onto the stripped wire ends and the blade 44 cuts the now secure terminals 50 from the strips 48 on which they were located. On its downstroke the cylinder D activates a cam, not shown, which causes the feed fingers to move the three terminals strips forward on the table 46 when the cylinder D retracts to lift the holder frame 12, under the bias of the spring 33, to its upper position in the drawing and the now crimped wire ends from the anvil 20. At the end of the upward stroke of the platten 38 the air cylinder A retracts the gripper 28 to free the conductors from the bores 26 of the holder 10. Should the crimp lugs 50 be those which include flattend terminals which project beyond the width of the insulation on the conductor 60 the bores 26 in the holder would include cut-outs to enable the lugs to be drawn through the bores from the holder 10.

I claim:

1. A method of stripping and terminating the conductors of a multi core electrical cable including the steps of stripping a length of the outer insulation from one end of the cable to expose the separately insulated cable conductors, locating the insulated cable conductors in a holder with the free ends of the insulated conductors projecting in a spaced parallel relationship from the holder, activating a gripper to grip the insulation of the conductors in the holder, activating an insulation stripper to cut the insulation on each of the conductors at a predetermined distance from its free end and to hold the insulation between the cuts and free ends of the conductors, moving the holder while gripping the conductors in the axial direction of the conductors away from the stripper, to strip the free ends of the conductors from the insulation which is held by the stripper, to a position in which the stripped ends of the conductors are in register with the crimp portions of pre-located crimp-on electrical terminals and terminating the conductors by activating a crimp punch to crimp the terminals to the stripped ends of the conductors.

2. A method as claimed in claim 1 of the stripping and terminating conductors of a multi core electrical cable including the step of vertically lowering the holder without a change of direction from the position in which the stripped ends of the conductors are in register with the crimp-on portions of the terminals and then activating the crimp punch.

3. Apparatus for stripping and terminating the conductors of a multi core electrical cable which carries separately insulated electrical conductors which are exposed at one end of the cable including a holder for holding the insulated conductors with the free end of each conductor projecting from the holder, a gripper for gripping the insulation of the conductors in the holder, means for actuating the gripper, a stripper arrangement including blades for cutting the insulation on each conductor at a predetermined distance from its free end and for holding the insulation between the cuts and the free ends of the conductors, means for actuating the stripper arrangement, means for moving the holder in the axial direction of the conductors to a second position away from the stripper arrangement to strip the free ends of the conductors from the insulation when held by the stripper, a crimp anvil which is located directly below the stripped ends of the conductors in the second position of the holder, a crimp punch and means for activating the crimp punch to crimp lugs located on the anvil to the stripped ends of the conductors.

4. Apparatus as claimed in claim 3 for stripping and terminating the conductors of a multi core electrical cable including means for vertically lowering the holder without a change of direction from its second position to a third position in which the stripped ends of the conductors are located on the crimp portions of crimp lugs which are located on the crimp anvil in use.

5. Apparatus as claimed in claim 4 for stripping and terminating the conductors of a multi core electrical cable including a table which is aligned with the crimp anvil and means which is activated by the holder lowering means to feed the crimp-on electrical terminals in a strip onto the anvil from strip guides on the table when lugs on the anvil are crimped onto the stripped ends of conductors in use.

6. Apparatus as claimed in claim 5 for stripping and terminating the conductors of a multi core electrical cable including a terminal cutter which is operated by the crimp punch to cut terminals from the strips which carry them when the terminals have been crimped onto the stripped ends of the conductors by the punch in use.

7. Apparatus as claimed in claim 5 for stripping and terminating the conductors of a multi core electrical cable in which the gripper, stripper, holder moving and crimp punch actuating means are air cylinders which are inter-connected by suitable connecting arrangements for sequential operation.

* * * * *